United States Patent [19]

Langham

[11] Patent Number: 4,714,285

[45] Date of Patent: Dec. 22, 1987

[54] FIRE-BREAK DOOR

[75] Inventor: Richard J. Langham, St. Peter Port, Great Britain

[73] Assignee: D.R.I.M. Limited, Great Britain

[21] Appl. No.: 692,785

[22] Filed: Jan. 17, 1985

[30] Foreign Application Priority Data

Mar. 27, 1984 [BE] Belgium ..... 0/212637

[51] Int. Cl.[4] ..... E05B 17/20

[52] U.S. Cl. ..... 292/163; 292/DIG. 66; 292/DIG. 65; 292/1

[58] Field of Search ..... 29/526; 292/DIG. 65, 292/DIG. 66, 163, 333, 1

[56] References Cited

U.S. PATENT DOCUMENTS 3,605,902 9/1971 Ault .
4,073,525 2/1978 Gurule ..... 292/150
4,161,804 7/1979 D'Hooge et al. ..... 292/DIG. 66 X
4,183,565 1/1980 Allemann ..... 292/150

FOREIGN PATENT DOCUMENTS 1549636 8/1979 United Kingdom ..... 292/DIG. 66

*Primary Examiner*—Richard E. Moore
*Attorney, Agent, or Firm*—Laff, Whitesel, Conte & Saret

[57] ABSTRACT

There is described a fire-break door comprising a swivelling leaf provided with at least one lock with drawbolt which can be controlled by an operating member, said leaf cooperating with a door-closer allowing to swing said leaf back automatically to the closed position thereof, in which means are provided on the one hand to retain the lock bolt in a recessed or withdrawn position when the door leaf lies in closed position, and on the other hand to let the bolt be released and enter the keeper of the lock with an abnormal rise in the temperature adjacent the door.

5 Claims, 3 Drawing Figures

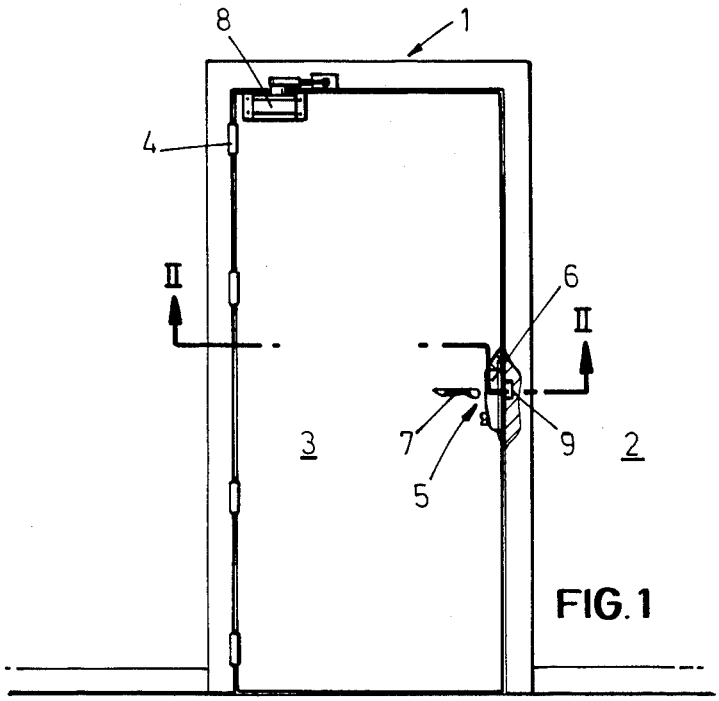
FIG. 1
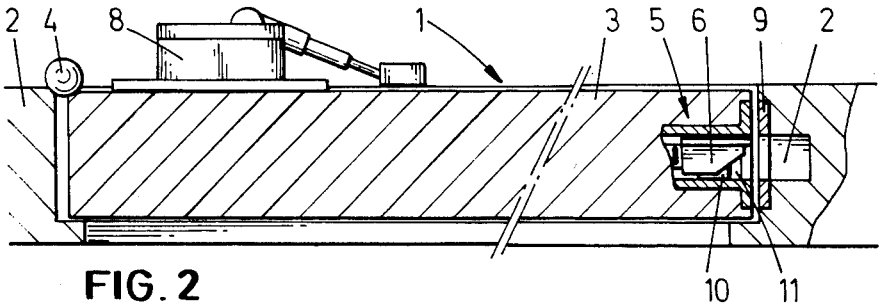
FIG. 2
FIG. 3
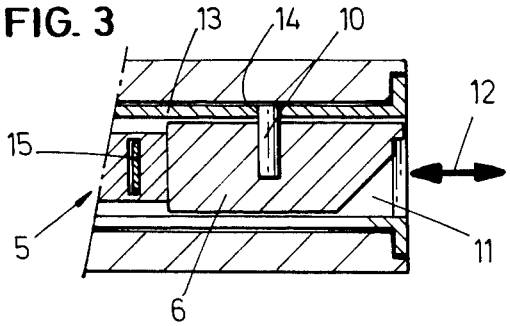

FIRE-BREAK DOOR

This invention relates to a fire-break door comprising a swivelling leaf provided with at least one draw-bolt which can be controlled by an operating member, said leaf cooperating with a door-closer allowing to swing same back automatically to the closed position thereof.

One essential object of this invention is to provide a fire-break door which combines the essential advantages of a swinging door and a door which is closable by means of a latch.

The advantage of a swinging door is to always close automatically and completely, while the advantage of a latch door is to allow closing the door by means of a bolt entering a keeper provided on the door casing. It is thus possible to obtain a substantially tight closing of the door in the case of fire, even when an overpressure is caused on the one side thereof. When use is made of a normal swinging door, specific precautions have to be taken to insure such tightness.

For this purpose according to the invention, means are provided on the one hand to retain the lock bolt in a recessed position when the door leaf lies in closed position, and on the other hand to allow the bolt to be released and enter the lock keeper with an abnormal rise in temperature adjacent the door.

Advantageously, said means comprise a fusible material preventing the bolt entering the keeper.

In a particularly advantageous embodiment, said means comprise at least one locking member made from the fusible material and extending cross-wise to the bolt movement direction, through the side wall of the lock case, down at least to some depth in the bolt in recessed position, so as to retain said latter bolt in said position.

In a preferred embodiment of the invention, the fusible material is comprised of a bismuth alloy comprising about 50% bismuth, 25% lead, 12.5% tin, and 12.5% cadmium.

The invention further pertains to a method for manufacturing a fire-break door having the above-defined features.

Said method is characterized in that it comprises retaining temporarily the draw-bolt in the recessed position thereof inside the lock case, drilling thereafter along a direction substantially at right angle to the bolt movement direction, at least one hole through the side wall of the lock case, facing the bolt, down to some depth therein, feeding during a subsequent step, a fusible material in paste or molten condition into said hole, letting said material harden, and finally releasing the bolt which remains in the recessed position thereof due to the presence of the locking member thus obtained by means of the fusible material.

The invention finally pertains to a lock with drawlock cooperating with a spring against a hand operating member, characterized by the presence of means for on the one hand retaining the bolt in a withdrawn position against the spring action, and on the other hand letting the bolt be released under the spring action with an abnormal rise in temperature of the lock.

Other details and features of the invention will stand out from the following description, given by way of non limitative example and with reference to the accompanying drawings, in which:

FIG. 1 is an elevation front view with parts broken away, of a fire-break door in a first embodiment of the invention.

FIG. 2 is a section view on a larger scale, along line II—II in FIG. 1.

FIG. 3 is a part view in horizontal cross-section, on a larger scale, level with the draw-bolt, of a fire-break door in a second embodiment of the invention.

In the various figures, the same reference numerals pertain to identical or similar elements.

FIG. 1 shows a fire-break door 1 arranged in an opening provided in a wall 2.

Said fire-break door comprises a leaf 3 swivelling about four hinges 4.

Said leaf is provided with a conventional lock 5 having a draw- or spring-bolt 6 controlled by a spiral spring 15 and by a hand operating member, comprised of a latch 7, against the action of spring 15.

Moreover the leaf 3 cooperates with a door-closer 8 allowing to swing said leaf back automatically to the closed position thereof, as shown in FIGS. 1 and 2.

The invention generally lies in providing means on the one hand to retain the bolt 6 of lock 5 in a recessed or withdrawn position, against the action of spring 15, when the leaf 3 lies in closed position, and on the other hand in letting said bolt 6 be released and enter under the action of spring 15, the keeper 9 of lock 5 with an abnormal rise in temperature adjacent the door 1, for example due to a fire.

More particularly, said means comprise a fusible material 10 preventing bolt 6 entering the keeper 9.

FIGS. 1 and 2 show a first particular embodiment of said means.

In this embodiment, the fusible material 10 is secured in the entrance to the recess 11 in lock 5, wherein the bolt 6 lies in recessed position.

In the embodiment as shown in FIG. 3, the means for preventing the bolt entering the keeper in the door closed position comprise at least one locking member made from the fusible material 10 and extending crosswise relative to the movement direction 12 of bolt 6, through the side wall of case 13 from lock 5, down to some depth in the body of bolt 6, as said latter bolt lies in withdrawn position. Consequently said member prevents the bolt coming out of the recess 11 thereof.

In each one of both said embodiments of the invention, the fusible material 10 is preferably arranged in position in molten or possibly paste-like condition.

Said material is advantageously comprised of a metal having a melting point lying between 60° and 80° C., preferably in the range of 70° C.

Very satisfactory results have been obtained with a fusible material 10 comprised of a bismuth alloy.

This is more specifically an alloy containing about 50% bismuth, 25% lead, 12.5% tin, and 12.5% cadmium. Such an alloy which has a melting point in the range of 72° C., is known under the name of Wood's metal.

The embodiment as shown in FIG. 3 has the advantage that it is possible to obtain a very efficient locking of bolt 6 by using a very small amount of fusible material 10.

Still another advantage of this embodiment lies in said fusible material being very easy to apply without having to resort to skilled workmen or special tools.

In this respect according to the invention, the drawbolt 6 is temporarily retained in the withdrawn position thereof, for example by means of a clamp or a suitable wedge which may then easily be removed thereafter.

Then one drills along a direction substantially at right angle to the movement direction 12 of bolt 6, at least one hole 14 through the side wall of case 13 from lock 5, substantially level with the middle of bolt 6 for example, down to some depth therein, to obtain a cylinder-shaped cavity.

Thus during a subsequent step, into said cavity is fed some amount of fusible material 10 in paste-like or preferably molten condition, in such a way as to fill completely said cavity.

Said material is then left to harden, and finally the bolt 6 is released, for example by removing the above-mentioned retaining means.

The bolt then remains in the withdrawn or recessed position thereof due to the presence of the fusible material 10, which forms consequently as it were a pin or peg.

There results from the above that the complete closing of the door is no more dependent on the resistance of the spring 15 acting on bolt 6, on the shape of said latter bolt, or on the relative arrangement of the bolt with respect to keeper 9.

On the other hand, in the case of a fire, when the door temperature reaches an abnormal temperature higher than the melting temperature of material 10, said material will melt and let bolt 6 be released fast from the housing thereof inside the lock case, to enter the keeper.

This will result in the door being locked in the closed position thereof, but being openable simply by operating latch 7, as in the case of a conventional door, for example to let people trapped inside a room where a fire starts, escape fast therefrom.

Moreover as in the case of a fire, the bolt engages the keeper, this allows to insure a good tightness for the door, contrary to what is generally the case with swinging doors, particularly when an overpressure or underpressure is caused on the one door side.

It must be understood that this invention is not limited to the above embodiments and that many changes may be brought therein without departing from the scope of the invention as defined by the appended claims.

For instance, it would be possible to use as fusible material, glues or even adhesive strips which have a relatively low melting point, in the range from 60° to 80° C., or else a small plate from fusible material located at the entrance to the bolt housing, so as to retain said latter bolt inside the housing thereof.

On the other hand, in some cases, it would be possible to provide a plurality of latch locks on one and the same leaf, so as to improve the tightness between the leaf and the door rabbet, and avoid the distortion of the leaf under the fire action.

In such a case, the locks might serve as latching bars and be arranged for example on the upper and lower door portions.

The fusible material might further be replaced by a bimetal system allowing to lock the draw-bolt in the recessed position thereof under a normal temperature, and releasing said bolt when the temperature reaches an abnormally high value. This does however comprise a solution which is generally of less interest from the economical view point, but which might however be useful in some very specific cases.

Another solution would lie in using a memory alloy. It would for example be possible to make the spring 15 from such an alloy, so as to retain the bolt in the recessed position thereof as long as the temperature does not rise to an abnormal value, and when such a temperature is reached, the spring might release by acting on the bolt and pushing same out of the housing thereof.

Finally, another solution according to the invention would be to close-off the keeper 9 with a fusible material 10, to prevent the bolt entering same when the door lies in the closed position thereof. Thus it would also be possible to open the door during the normal use thereof, simply by pushing the door leaf, in the same way as a swinging door.

I claim:

1. A fire-break door comprising a door having at least one lock including a lock housing with a spring biased latch contained therein, said latch being moved from a latched position to a retracted position by an operating member, said spring bias urging said latch toward said latched position, said door cooperating with a door-closer for enabling it to automatically move said door back to the closed position, means comprising a fusible material secured in the entrance to the lock housing wherein the latch lies when in its recessed position, so as to lock said latch in such a recessed position by means of the fusible material to retain the latch in said retracted position against the bias action of the spring, said fusible material engaging said latch to prevent the latch from entering a keeper of the lock until said fusible material melts, said fusible material letting the latch be released to said latched position where it enters a keeper of the lock under the bias action of said spring in response to an abnormal rise in the temperature adjacent to the door, the operating member cooperating with the latch which is released by the fusible material for manually returning the latch into said retracted position against the spring bias action of the spring for opening the door whereby said door may be opened easily after the latch has been released in response to said high temperature.

2. A fire-break door comprising a door including at least one lock having a lock case with a spring biased latch contained therein, said lock case and said latch have holes which are aligned when said latch is in the retracted position, said latch being moved from a latched position to a retracted position by an operating member, said spring bias urging said latch toward said latched position, said door cooperating with a door-closer for enabling it to automatically move said door back to the closed position, means comprising a fusible material in the lock located to retain the latch in said retracted position against the bias action of the spring, at least one locking member made from said fusible material and extending through said holes and crosswise relative to the direction of movement of the latch toward said latched position, said fusible material further extending through a side wall of the lock case, and down to some depth in at least the latch lying in its recessed position, so as to retain said bolt in such a recessed position, said locking member engaging said latch to prevent the latch from entering a keeper until said fusible material melts and letting the latch be released to said latched position where it enters a keeper of the lock under the bias action of said spring in response to an abnormal rise in the temperature adjacent to the door, the operating member cooperating with the latch which is released by the fusible material for manually returning the latch into said retracted position against the spring bias action of the spring for opening the door whereby said door may be opened easily after the latch has been released in response to said high temperature.

3. A fire-break door comprising a door including at least one lock having a lock case with a spring biased latch contained therein, said latch being moved from a latched position toward a retracted position by an operating member, said spring bias urging said latch to said latched position, said door cooperating with a door-closer for enabling it to automatically move said door back to the closed position, means comprising a fusible material in the lock located to retain the latch in said retracted position against the bias action of the spring, said fusible material engaging said latch to prevent the latch from entering a keeper until said fusible material melts, the fusible material being arranged in position while in a molten or paste-like condition, said fusible material letting the latch be released to said latched position where it enters a keeper of the lock under the bias action of said spring in response to an abnormal rise in the temperature adjacent to the door, the operating member cooperating with the latch which is released by the fusible material for manually returning the latch into said retracted position against the spring bias action of the spring for opening the door whereby said door may be opened easily after the latch has been released in response to said high temperature.

4. A fire-break door comprising a door with at least one lock having a lock case with a spring biased latch contained therein, said latch being moved from a latched position toward a retracted position by an operating member, said spring bias urging said latch to said latched position, said door cooperating with a door-closer for enabling it to automatically move said door back to the closed position, means comprising a fusible material in the lock located to retain the latch in said retracted position against the bias action of the spring and for letting the latch be released to said latched position where it enters a keeper of the lock under the bias action of said spring in response to an abnormal rise in the temperature adjacent to the door, the fusible material being comprised of a bismuth metal alloy having a melting point lying between 60° and 80° C., preferably in the range of 70° C., the alloy being about 50% bismuth, 25% lead, 12.5% tin, and 12.5% cadmium, the operating member cooperating with the latch which is released by the fusible material for manually returning the latch into said retracted position against the spring bias action of the spring for opening the door whereby said door may be opened easily after the latch has been released by said high temperature.

5. A method for manufacturing a fire-break door comprising a door including at least one lock having a lock case with a spring biased latch contained therein, said latch being moved from a latched position toward a retracted position by an operating member, said spring bias urging said latch to said latched position, said door cooperating with a door-closer for enabling it to automatically move said door back to the closed position, means comprising a fusible material in the lock located to retain the latch in said retracted position against the bias action of the spring and for letting the latch be released to said latched position where it enters a keeper of the lock under the bias action of said spring in response to an abnormal rise in the temperature adjacent to the door, the operating member cooperating with the latch which is released by the fusible material for manually returning the latch into said retracted position against the spring bias action of the spring for opening the door whereby said door may be opened easily after the latch has been released in response to said high temperature, said method comprising temporarily retaining the latch in the recessed position within the lock case, then drilling along a direction which is substantially at a right angle to the movement direction of the latch, at least one hole being formed through a said wall of the lock case, said wall facing the latch, said one hole extending down to some depth therein, during a later step, feeding a fusible material in a paste-like or molten condition into said hole, letting said fusible material harden, and finally releasing the latch, which then remains in the withdrawn position thereof due to the presence of the fusible material.

* * * * *